US008224230B2

(12) United States Patent
Isokawa

(10) Patent No.: US 8,224,230 B2
(45) Date of Patent: Jul. 17, 2012

(54) IMAGE FORMING APPARATUS HAVING A SEPARATION SECTION WHICH MOVES IN AN AXIAL DIRECTION OF AN IMAGE CARRIER, FOR SEPARATING A TRANSFER SHEET FROM THE IMAGE CARRIER

(75) Inventor: Hiroshi Isokawa, Hino (JP)

(73) Assignee: Konica Minolta Business Tech., Inc., Tokyo (JP)

( * ) Notice: Subject to any disclaimer, the term of this patent is extended or adjusted under 35 U.S.C. 154(b) by 393 days.

(21) Appl. No.: 12/464,216

(22) Filed: May 12, 2009

(65) Prior Publication Data

US 2009/0285599 A1 Nov. 19, 2009

(30) Foreign Application Priority Data

May 16, 2008 (JP) ..... 2008-129348

(51) Int. Cl.
*G03G 15/14* (2006.01)

(52) U.S. Cl. ..... 399/399

(58) Field of Classification Search ..... 399/398, 399/399, 322, 323; 271/307, 308, 311–313, 271/900

See application file for complete search history.

(56) References Cited

U.S. PATENT DOCUMENTS 5,006,905 A * 4/1991 Satoh ..... 399/399
2007/0223975 A1* 9/2007 Yoshida ..... 399/323

FOREIGN PATENT DOCUMENTS

JP 9-269701 A 10/1997

* cited by examiner

*Primary Examiner* — David Porta
*Assistant Examiner* — Milton Gonzalez
(74) *Attorney, Agent, or Firm* — Holtz, Holtz, Goodman & Chick P.C.

(57) ABSTRACT

An image forming apparatus includes an image carrier; a toner image forming section; a transfer section which transfers the toner image onto a transfer sheet; a separation section which separates the transfer sheet from the image carrier; and a process cartridge which holds the image carrier, the toner image forming section, the transfer section, and the separation section as a unit detachable from a main unit of the image forming apparatus. The separation section includes a resin guide member which is a base for the separation section, a separation pawl for separating a transfer sheet from the image carrier, a metal reference plate fixed to the resin guide member and a resin engaging member fixed to the reference plate. The resin engaging member engages with a process cartridge member which supports the separation section allowing the separation section to move in an axial direction of the image carrier.

10 Claims, 6 Drawing Sheets

IMAGE FORMING APPARATUS HAVING A SEPARATION SECTION WHICH MOVES IN AN AXIAL DIRECTION OF AN IMAGE CARRIER, FOR SEPARATING A TRANSFER SHEET FROM THE IMAGE CARRIER

RELATED APPLICATION

This application is based on Japanese Patent Application No. 2008-129348 filed with Japanese Patent Office on May 16, 2008, the entire content of which is hereby incorporated by reference.

BACKGROUND OF THE INVENTION

1. Field of the Invention

The present invention relates to image forming apparatuses of the electrophotographic method and particular by to a separation section for separating transfer sheet from an image carrier.

2. Description of Related Art

In an electrophotographic process, as is well known, a toner image is formed on a transfer sheet by forming, developing and transferring an electrostatic latent image, and the electrophotographic process involves a separation operation for separating the transfer sheet from an image carrier. The most widely adopted separation technique removes electric charge from transfer sheet so that the electrostatic attractive force between an image carrier and transfer sheet is weakened or eliminated, thereby separating transfer sheet.

In this case, the separation is made taking advantage of the rectilinear property of transfer sheet due to its rigidity and the drum shape of an image carrier or the arc shape of a belt-like image carrier formed by roller support.

However, since a transfer sheet comes in different types, including thin sheet with low rigidity, or due to changes in environmental or other conditions, electrostatic separation taking advantage of the rigidity of transfer sheet cannot always ensure separation by itself and there may arise a case where separation is not achieved, which has led to the use of a separation pawl for physically separating transfer sheet.

In addition, the separation part of the separation pawl abuts an image carrier during the transfer operation, in which a toner image is transferred on transfer sheet. Therefore, if the separation pawl abuts only one part of an image carrier, wear occurs intensively only at this part, thereby reducing the service life of the image carrier. In order to avoid this, the separation pawl is usually moved in the axial (width) direction of an image carrier.

As apparatuses using the separation pawl, image forming apparatuses have been disclosed wherein the housing of a drum cartridge (process cartridge), a separation pawl support which is attached to the housing and the attaching structure thereof are all made of resin (see, for example, Japanese Unexamined Patent Application Publication No. 09-269701, hereinafter referred to as Patent Document 1).

Patent Document 1 discloses an apparatus wherein the whole separation pawl support of the drum cartridge and the whole attaching structure thereof are made of resin similarly to the housing, thereby making it easy to manufacture the drum cartridge.

However, when a plurality of components constituting a separation section are made solely of resin, or materials of the same sort, the vibrations of a process cartridge are easily transmitted between components and the vibrations can easily trigger resonances among components. Furthermore, since the separation section is supported by the components of a process cartridge which are made of resin, it is even more susceptible to the effect of vibrations. As a result, the separation pawl vibrates and exerts force toward the image carrier at the separation part of the separation pawl in contact with the image carrier, which has resulted in scratches on the surface of the image carrier. The scratches deteriorated the quality of formed images.

FIG. 6 is a schematic view showing an example of the vibration state of the tip of the separation pawl 44. In FIG. 6, position A in solid line is the reference position of the separation pawl 44 and positions B and C in dashed line are examples of the shifted tip.

In addition, an apparatus is also known wherein the housing of a process cartridge, a separation pawl support attached to the housing and the attaching structure thereof are all made of metal. Unfortunately, when they are made of metal as described above, since the support which supports the separation section and the engaging member of the separation section which is connected thereto are metal, there is no elasticity that resin components would have, and therefore vibrations are poorly absorbed and easily transmitted. Consequently, the surface of the image carrier has been scratched. Furthermore, as mentioned above, the slide member provided between the support and the engaging member for moving the separation pawl in the axial direction of the image carrier, among other things, has complicated the structure.

SUMMARY OF THE INVENTION

The present invention has been made in consideration of the above-mentioned situation and its object is to provide an image forming apparatus which can form high-quality images by preventing the separation pawl from scratching the surface of the image carrier due to its vibrations which are caused by the vibrations of the separation section affected by the vibrations of the process cartridge.

According to an image forming apparatus reflecting an aspect of the present invention, the image forming apparatus comprises: an image carrier; a toner image forming section which forms a toner image on the image carrier; a transfer section for transferring the toner image on the image carrier onto transfer sheet; a separation section which separates the transfer sheet from the image carrier; and a process cartridge for holding as a unit and detachably from a main unit of the image forming apparatus the image carrier, the toner image forming section, the transfer section, and the separation section, wherein the separation section comprises a resin guide member, which is a base for the separation section, a separation pawl for separating transfer sheet from the image carrier, a metal reference plate fixed to the resin guide member and a resin engaging member fixed to the reference plate, and wherein the resin engaging member engaging with a support member provided in the process cartridge so that the support member supports the separation section in a way that the separation section can move in an axial direction of the image carrier.

DETAILED DESCRIPTION OF THE PREFERRED EMBODIMENTS

Referring to the accompanying drawings, the embodiments of the present invention will be explained. However, the present invention is not limited to these embodiments.

Figure 1:
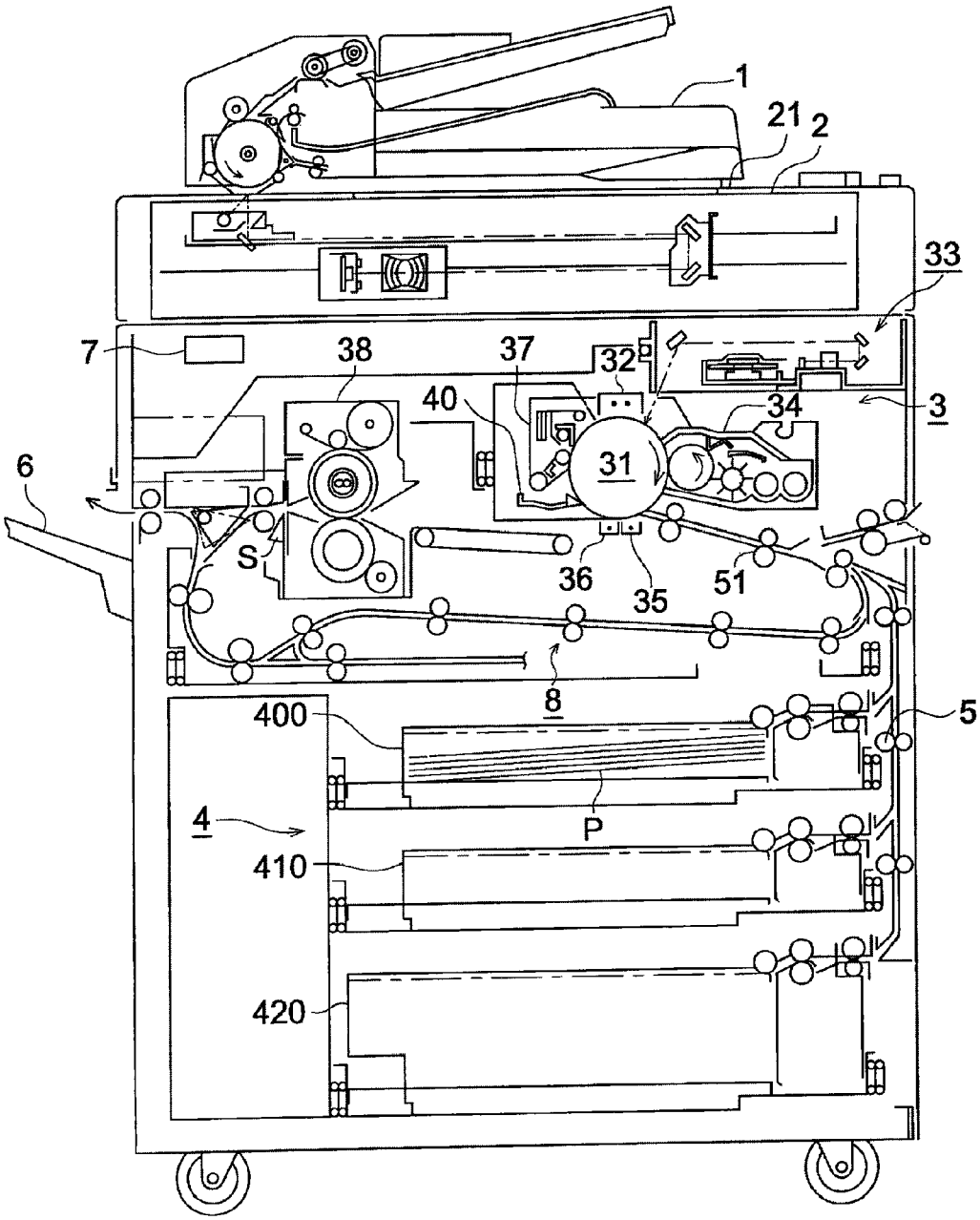
FIG. 1 is an overall view of an image forming apparatus in accordance with the present invention.

FIG. 1 is an overall view of an image forming apparatus in accordance with an embodiment of the present invention. The image forming apparatus has an original document feeder 1, an image reader 2, an image forming section 3, a transfer sheet cassette 4, a carrier 5, a sheet discharge tray 6, and a communication unit 7. The original document feeder 1 is a device for carrying multiple original documents sheet by sheet to a reading position. It has a carrying function for single side reading and a carrying function for double side reading wherein the original document is carried to the reading position so that one side of the original document is read and then reversed and carried to the reading position so that the other side of the original document is read.

The image reader 2 reads an original document carried by the original document carrier or an original document placed on an original document table 21 to generate image data.

The image forming section 3 forms an image on transfer sheet P based on the image data generated by the image reader 2 or generated by the communication unit 7. The image forming section 3 has: a photoreceptor 31 which is an image carrier; a charging device 32; an exposure device 33; a developing device 34; a transfer device 35 which is a transfer section; an electrical separation device 36 which facilitates the separation of the transfer sheet P from the photoreceptor 31; a transfer sheet separation device (hereinafter referred to simply as separation device) 40 which is a separation section provided with a separation pawl for physically separating the transfer sheet P from the photoreceptor 31; a cleaning device 37; and a fixing device 38. The charging device 32, the exposure device 33 and the developing device 34 constitute a toner image forming section for forming a toner image on the photoreceptor 31.

Figure 2:
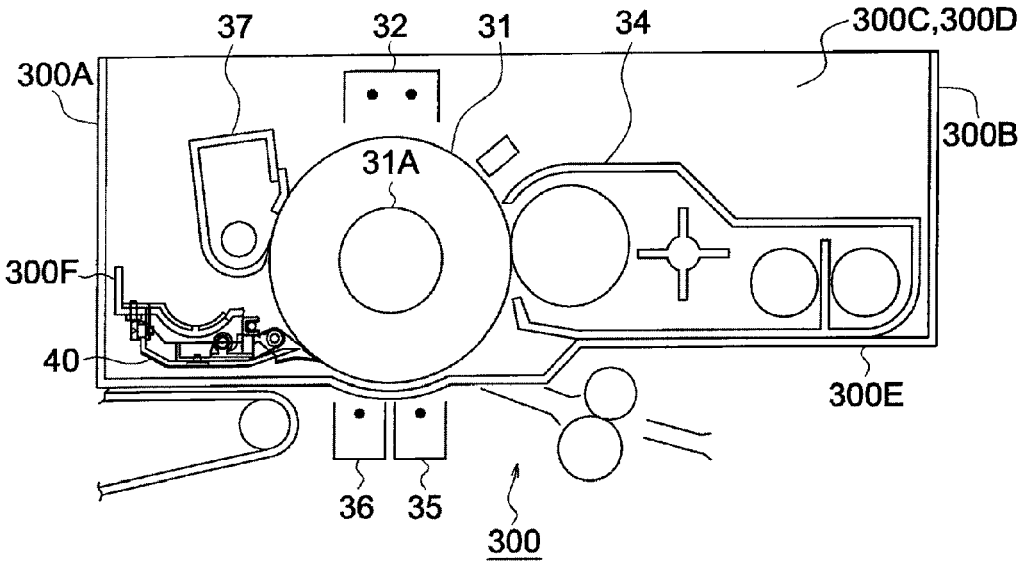
FIG. 2 is a cross-sectional view of the main parts of a process cartridge.

Meanwhile, the photoreceptor 31, the charging device 32, the developing device 34, the separation device 40, and the cleaning section 37 are, as shown in FIG. 2, held as a unit and withdrawably from the main unit in a process cartridge 300, whose substantially box-shaped housing comprises a left panel 300A, a right panel 300B, a first panel 300C, a second panel 300D, and a bottom panel 300E. Although the process cartridge 300 is made of metal in this present embodiment, it is not to be considered limited to this and may be made of resin. Here, the process cartridge is abbreviated as PC.

The transfer sheet cassette 4 has three sheet feeding trays 400, 410, 420.

The carrier 5 carries the transfer sheet P from the transfer sheet cassette 4 to the image forming section 3, and further, from the image forming section 3 to the sheet discharge tray 6. The carrier 5 has a plurality of carrying rollers including a registration roller 51 for carrying transfer sheet in synchronization with the formation of a toner image in the image forming section 3.

The transfer sheet P with an imaged formed thereon is discharged from the apparatus and stacked on the sheet discharge tray 6. The communication unit 7 communicates with external devices via a network. A reverse carrying route 8 reverses the transfer sheet P with an image formed on one side thereof and feeds it to the image forming section 3.

In image forming, the photoreceptor 31 rotates in the direction indicated by the arrow, wherein charging, exposure and development are conducted by the charging device 32, the exposure device 33 and the developing device 34 to form a toner image on the photoreceptor 31.

The toner image formed on the photoreceptor 31 is transferred onto the transfer sheet P carried by the registration roller 51. The transfer sheet P with the toner image formed thereon is separated from the photoreceptor 31 by the electrical separation device 36 and the separation device 40 and fixed by the fixing device 38.

The transfer sheet P which has passed the fixing device 38 is either discharged to the sheet discharge tray 6 or carried to the reverse carrying route 8. The transfer sheet P is carried to the reverse carrying route 8 in the case of double side image forming. The transfer sheet P carried to the reverse carrying route 8 is carried again to the image forming section 3, where a toner image is transferred thereon by the transfer device 35 and fixed, and then discharged to the sheet discharge tray 6.

In the image forming explained above, a negatively-charged OPC photoreceptor is used as the photoreceptor 31, wherein a toner image is formed by reversal development using negatively-charged toner.

Moreover, a corotron charger is used for the transfer device 35, wherein positive corona discharge is conducted on the back of the transfer sheet P to transfer negatively-charged toner onto the transfer sheet P.

A corotron charger is used for the electrical separation device 36, wherein the electric charge of the transfer sheet P is removed by AC corona discharge so that the electrostatic attractive force between the transfer sheet P and the photoreceptor 31 is eliminated or weakened, thereby separating the transfer sheet P from the photoreceptor 31. Furthermore, in order to ensure separation, the separation device 40 is provided.

Figure 3:
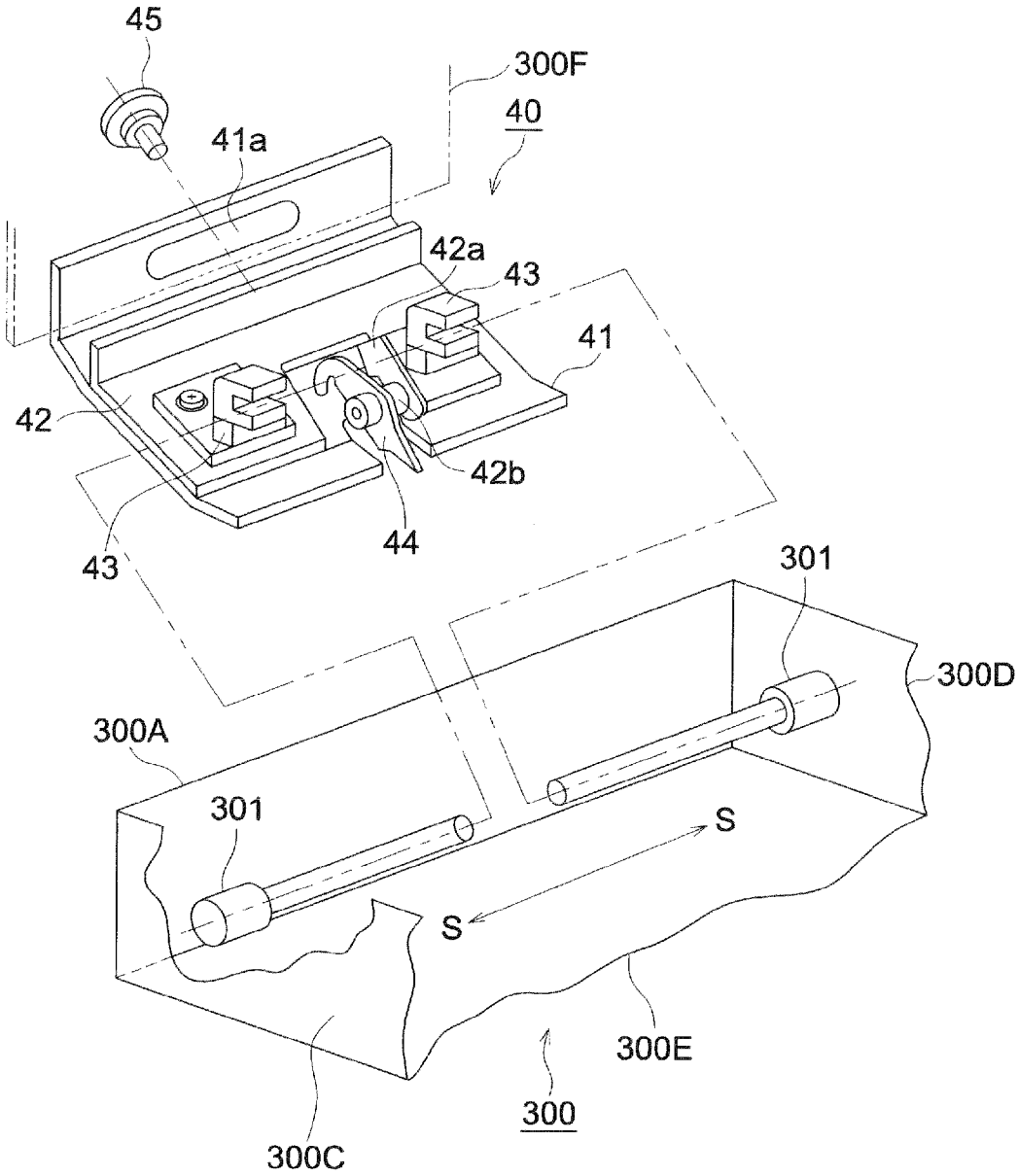
FIG. 3 is a schematic view of a separation device.
Figure 4:
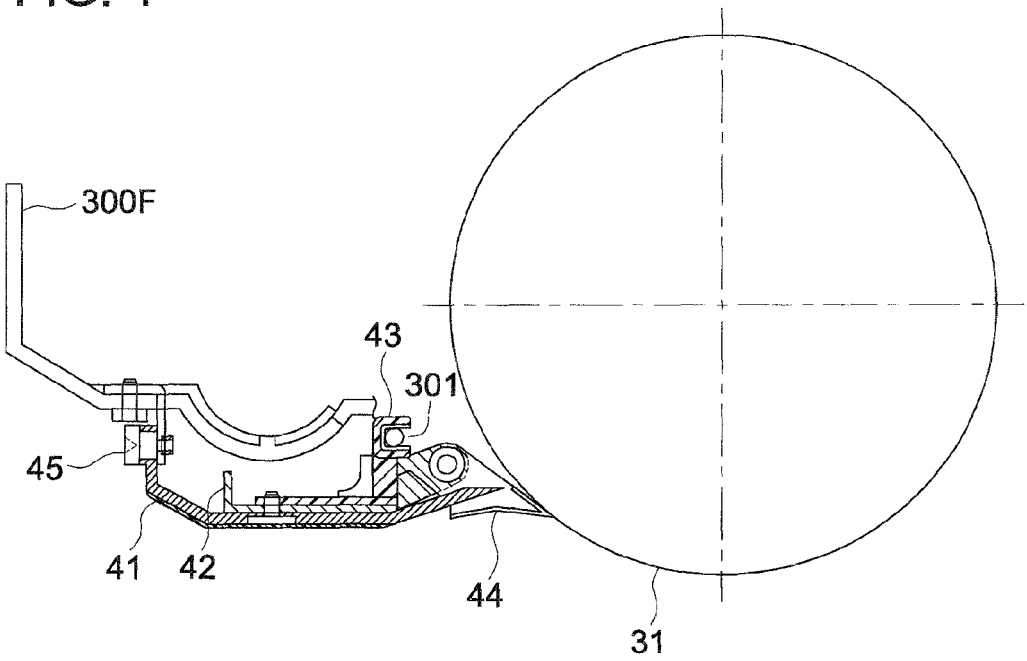
FIG. 4 is a lateral cross-sectional view of a separation device.

Next, the separation device 40 in accordance with the present invention will be explained. FIG. 3 is a schematic view of the separation device 40 and FIG. 4 is a lateral cross-sectional view of the separation device 40.

The separation device 40 comprises: a resin guide member 41, which is the base for the separation device 40; a separation pawl 44 for separating transfer sheet from the photoreceptor 31; a metal reference plate 42 fixed to the resin guide member 41; and a resin engaging member 43 fixed to the reference plate 42. The resin guide member 41, the reference plate 42, and the engaging member 43 are fixed by generally known fasteners, such as screws.

The top surface of the resin guide member 41 is a toner receiver for receiving the toner leaked from the cleaning device 37, which prevents the toner from dropping onto the transfer sheet P. Meanwhile, the undersurface of the resin guide member 41 is a sheet-conveying guide for guiding the transfer sheet P separated by the separation pawl 44. In addition, the metal reference plate 42 has a folding section 42*a* and a pawl support shaft 42*b* provided at the folding section 42*a*.

Figure 5:
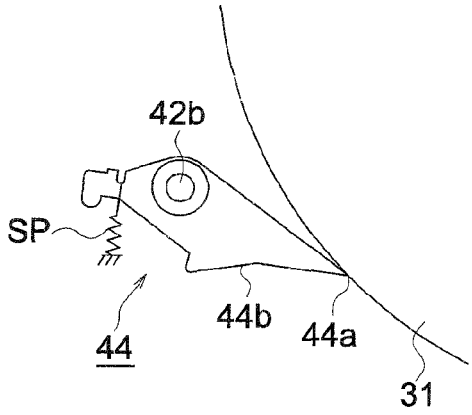
FIG. 5 is a segmental view showing a separation pawl.
Figure 6:
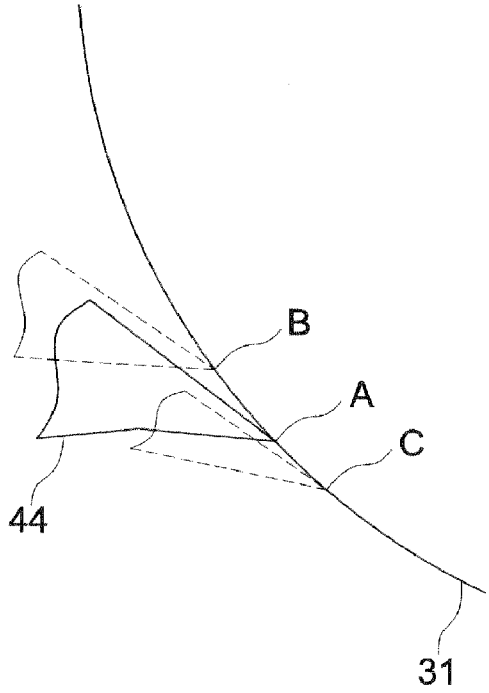
FIG. 6 shows the vibration state of the tip of a separation pawl.
Figure 7:
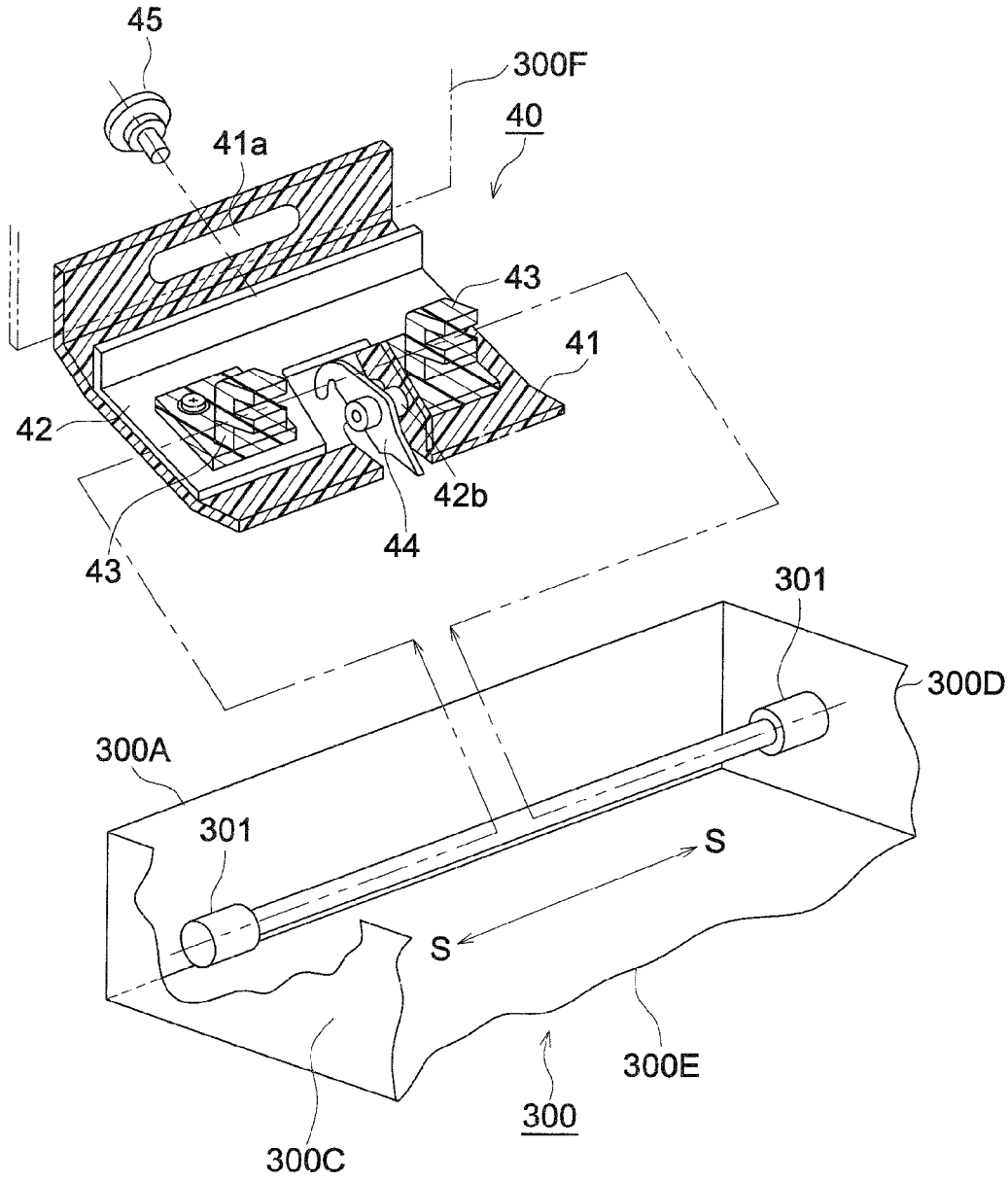
FIG. 7 is a schematic view of a modified separation device.

FIG. 5 is a segmental view showing the separation pawl 44. The separation pawl 44 is a plate-like member made of PI (polyimide) or PAI (polyamide-imide). As shown in FIG. 5, the separation pawl 44 has a wedge-shaped separation part 44*a* and a guideway 44*b* for guiding the transfer sheet P and is rotatably attached to the pawl support shaft 42*b* provided at the folding section 42*a* of the reference plate 42. In addition, the pawl support shaft 42*b* may be provided at the resin guide member 41 (see FIG. 7). The separation pawl 44 is urged by a spring SP and the separation part 44*a* contacts the surface of the photoreceptor 31. When the separation of the transfer sheet P from the photoreceptor 31 by the electrical separation device 36 is insufficient, the separation part 44*a* of the separation pawl 44 separates the transfer sheet P from the photoreceptor.

The separation device 40 shown in FIG. 3 is an example in which only one separation pawl 44 is provided. Preferably, however, a plurality of separation pawls 44 may be arranged in the axial direction of the photoreceptor 31 (in the width direction of the transfer sheet P), making it possible to separate transfer sheet P more easily.

The first panel 300C and the second panel 300D of the process cartridge 300 are each provided with a metal support shaft 301, which is a support for supporting the separation device 40. The support shaft 301 engages with the engaging member 43 of the separation device 40 to movably support the separation device 40 in the axis direction of the photoreceptor 31, or in the direction of the arrow SS shown in FIG. 3. The support shaft 301 may be one through shaft (see FIG. 7).

The slotted hole 41*a* of the resin guide member 41 is engaged with a shoulder screw 45 with a guide member 300F provided in the process cartridge 300, whereby the separation device 40 is movable in the direction of the arrow SS shown in FIG. 3 and rotation around the support shaft 301 is prevented.

As described above, the separation device 40, guided by the support shaft 301 and the guide member 300F, is movable in the direction of the arrow SS by means of a movement mechanism (not shown in the drawings). This can prevent the separation part 44*a* of the separation pawl 44 from abutting only one part of the photoreceptor 31 and wearing the photoreceptor 31, thus improving the service life of the photoreceptor 31.

As described above, in the separation device 40, the resin guide member 41 made of resin which supports the entire separation device 40, and the engaging member 43 made of resin are fixed via the metal reference plate 42 made of metal. Therefore, the vibrations which the engaging member 43 receives from the support shaft 301 of the process cartridge 300 are transmitted between different materials, from resin to metal to resin. In this way, the vibrations are transmitted between different materials with different characteristic frequencies, which means they are less easily transmitted than when transmitted between materials of the same sort. In addition, resonance can be prevented from occurring. As a result of this, the vibrations of the separation device 40 caused by the vibrations of the process cartridge 300 can be reduced, thereby preventing scratches on the surface of the photoreceptor 31 due to the vibration of the separation pawl 44 and making it possible to form high-quality images.

Furthermore, being made of resin, the engaging member 43 can absorb and reduce the vibrations it receives from the support shaft 301. In addition, the sliding properties of the engaging member 43 and the support shaft 301 can be improved so that the structure for moving the separation pawl in the axial direction of the image carrier can be simplified.

As described above, the vibrations of the separation section caused by the vibrations of the process cartridge can be reduced, thus reducing the vibrations of the separation pawl. This can prevent scratches on the surface of the image carrier due to the vibrations of the separation pawl and prevent the deterioration in the quality of formed images, making it possible to form high-quality images.

What is claimed is:

1. An image forming apparatus comprising:

an image carrier;

a toner image forming section which forms a toner image on the image carrier;

a transfer section for transferring the toner image on the image carrier onto a transfer sheet;

a separation section which separates the transfer sheet from the image carrier; and a process cartridge for holding as a unit and detachably from a main unit of the image forming apparatus the image carrier, the toner image forming section, the transfer section, and the separation section, wherein the separation section comprises a resin guide member, which is a base for the separation section, a separation pawl for separating the transfer sheet from the image carrier, a metal reference plate fixed to the resin guide member and a resin engaging member fixed to the reference plate, and wherein the resin engaging member engages with a support member provided in the process cartridge so that the support member supports the separation section such that the separation section can move in an axial direction of the image carrier.

2. The image forming apparatus of claim 1, wherein:

an undersurface of the resin guide member comprises a sheet-conveying guide for guiding the transfer sheet; and a top surface of the resin guide member comprises a toner receiver for receiving a toner.

3. The image forming apparatus of claim 2, wherein the separation pawl is supported by one of the resin guide member and the metal reference plate.

4. The image forming apparatus of claim 2, wherein the support member comprises a shaft provided on a first panel and a shaft provided on a second panel, the first panel and the second panel comprising a part of the process cartridge respectively.

5. The image forming apparatus of claim 2, wherein the support member comprises one support shaft provided on a first panel and a second panel, the first panel and the second panel comprising a part of the process cartridge respectively.

6. The image forming apparatus of claim 1, wherein the separation pawl is supported by one of the resin guide member and the metal reference plate.

7. The image forming apparatus of claim 6, wherein the support member comprises a shaft provided on a first panel and a shaft provided on a second panel, the first panel and the second panel comprising a part of the process cartridge respectively.

8. The image forming apparatus of claim 6, wherein the support member comprises one support shaft provided on a first panel and a second panel, the first panel and the second panel comprising a part of the process cartridge respectively.

9. The image forming apparatus of claim 1, wherein the support member comprises a shaft provided on a first panel and a shaft provided on a second panel, the first panel and the second panel comprising a part of the process cartridge respectively.

10. The image forming apparatus of claim 1, wherein the support member comprises one support shaft provided on a first panel and a second panel, the first panel and the second panel comprising a part of the process cartridge respectively.

* * * * *